US005125809A

United States Patent [19]

Hartley et al.

[11] Patent Number: 5,125,809

[45] Date of Patent: Jun. 30, 1992

[54] WOBBLE PLATE PUMP

[75] Inventors: E. Dale Hartley, Malibu; F. Scott Hartley, Camarillo, both of Calif.

[73] Assignee: Product Research And Development, Santa Ana, Calif.

[21] Appl. No.: 499,765

[22] Filed: Mar. 27, 1990

[51] Int. Cl.[5] ..... F01C 1/02; F04C 2/02

[52] U.S. Cl. ..... 418/53; 418/153

[58] Field of Search ..... 418/53, 153

[56] References Cited

U.S. PATENT DOCUMENTS

| | | | |
|---|---|---|---|
| 2,887,059 | 5/1959 | Cornelius | 418/53 |
| 3,485,218 | 12/1969 | Clarke | 418/53 |
| 3,946,617 | 3/1976 | Moriarty | 74/60 |
| 4,008,987 | 2/1977 | Ritchie | 418/53 |
| 4,229,150 | 10/1980 | Teague, Jr. et al. | 418/53 |
| 4,318,675 | 3/1982 | Clarke et al. | 418/53 |
| 4,324,536 | 4/1982 | Shank | 418/53 |
| 4,797,069 | 1/1989 | Hartley et al. | 417/222 |

FOREIGN PATENT DOCUMENTS

| | | | |
|---|---|---|---|
| 58-65984 | 4/1983 | Japan | 418/53 |
| 2215780 | 9/1989 | United Kingdom | 418/53 |

*Primary Examiner*—Richard A. Bertsch
*Assistant Examiner*—David L. Cavanaugh
*Attorney, Agent, or Firm*—Gordon L. Peterson

[57] ABSTRACT

A pump assembly comprising a housing having a cavity therein, an inlet leading to the cavity and an outlet leading from the cavity and a wobble plate mounted for nutating movement in the cavity. The wobble plate divides the cavity into first and second pumping chambers, and during its nutating movement, liquid entering the inlet into the pumping chambers is pumped by the wobble plate through the outlet. The pump can be driven by a motor.

6 Claims, 4 Drawing Sheets

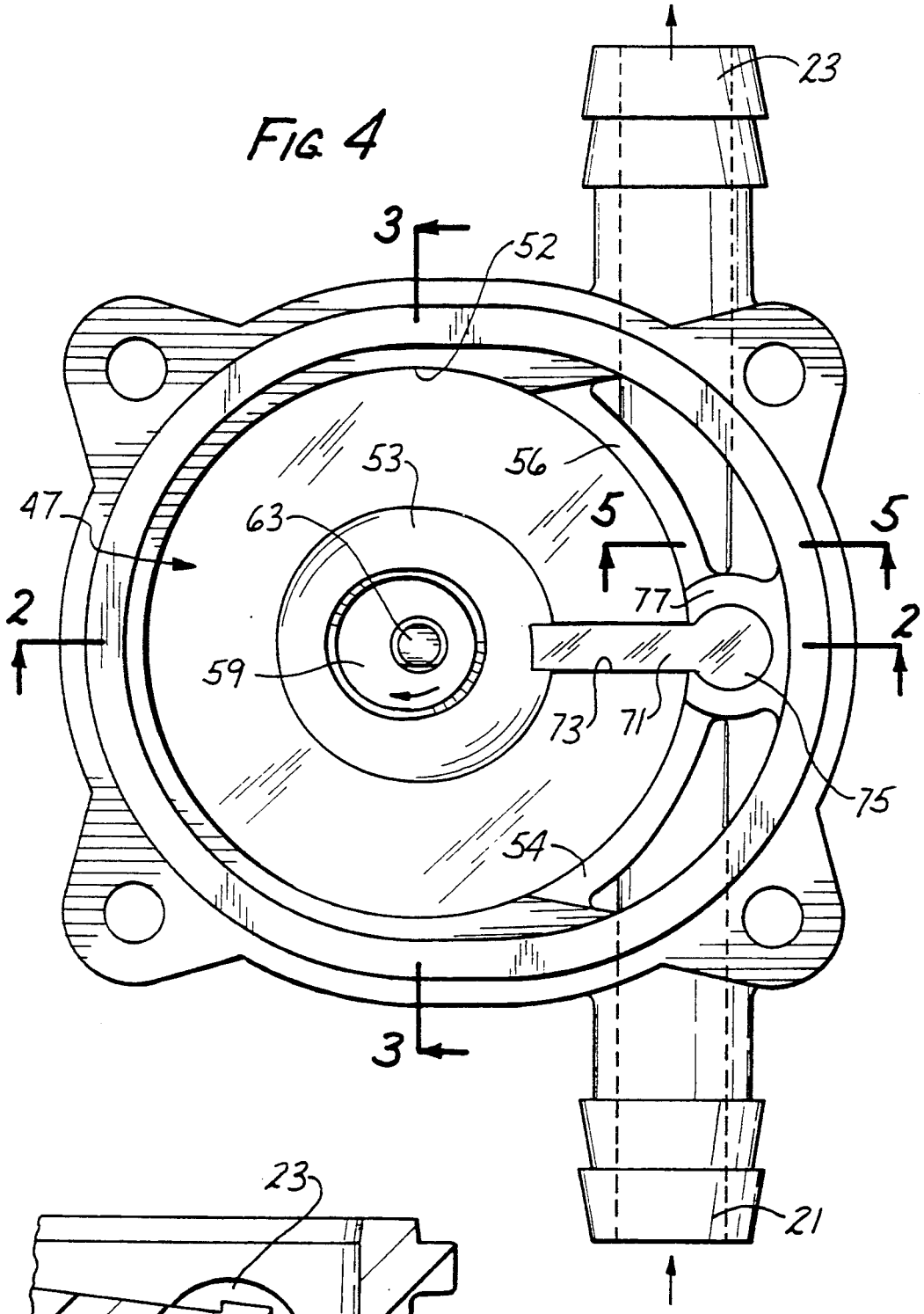
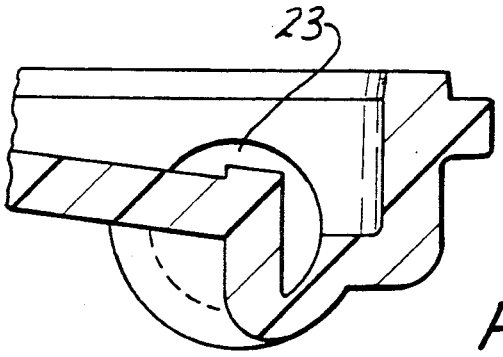
FIG. 5

WOBBLE PLATE PUMP

BACKGROUND OF THE INVENTION

A positive displacement pump typically utilizes a piston or diaphragm to act as a pumping member to move a liquid. The piston or diaphragm is reciprocated, and this tends to provide a pulsed output. The pulses or output surges can be reduced by using multiple chambers each with its own reciprocating member. However, typically the output from a positive displacement pump is not as even and continuous as may be desired for certain applications.

The pumping member or members can be reciprocated in various different ways. For example, in Hartley U.S. Pat. No. 4,797,069 a wobble plate is used in the drive train to drive multiple pistons in order to provide a multiple chamber pump. Although this pump works extremely well, it inherently provides a somewhat pulsed output.

In another prior art construction, a curved or wavy plate is rotated in a pumping chamber, with the curves of the plate providing the pumping action. This does reduce output surges. However, a separator slides back and forth in a slot to separate the liquid at inlet pressure from the liquid at outlet pressure, and it is difficult to seal the gap through which the separator moves. This wavy plate does not nutate and is of a rather complex configuration.

It is also known to rotate an inclined, flat plate in a pumping chamber. Although this is a simpler construction than the wavy plate, the inclined plate does not nutate and is subject to sealing problems.

SUMMARY OF THE INVENTION

This invention provides a positive displacement pump in which output surges are eliminated or substantially reduced and which is not subject to the sealing problem noted above. These advantages are obtained even though the pump of the present invention is of simpler construction.

According to this invention, a wobble plate, i.e., a plate mounted for nutating motion, is utilized in a pumping chamber as the pumping member. The nutating motion of the wobble plate provides the pump with an essentially constant, i.e., nonpulsating, output. Also, by using the wobble plate as the pumping member rather than in the drive train leading to a piston or diaphragm-type pumping member, substantial simplification is achieved. Also, the wobble plate is of simple construction, need not be of a wavy configuration and is not subject to the sealing problem referred to above.

A pump constructed in accordance with this invention may include a housing having a cavity therein, an inlet leading to the cavity, an outlet leading from the cavity and a wobble plate in the cavity which divides the cavity into first and second pumping chambers. The mounting plate is mounted for nutating movement in the cavity so that liquid entering the inlet into the pumping chamber is pumped by the wobble plate through the outlet. Motor means drives the wobble plate in such nutating movement to provide a pumping assembly.

Water meters similar to this construction have been known for many years. However, these water meters have no motor means and are driven by the water which flows through them with the movement of an output shaft along a conical path reflecting the quantity of water which flows through the water meter. Although water meters of this type have been known for many years, so far as we are aware, these water meters have not been modified to serve as pumps.

In a preferred construction, the housing has an opening leading to the cavity, and the pump includes a separator dividing the opening into the inlet and the outlet. The separator is fixedly mounted on the pump housing, and so the sealing problems associated with a sliding separator are eliminated, and the pump construction is simplified. The mounting means for the wobble plate includes a slot in the wobble plate which receives the separator so that the separator holds the wobble plate against rotation.

The wobble plate includes a central hub, which is preferably of part-spherical configuration, and a flange circumscribing the hub. The flange, which does the pumping, can be flat and planar.

The cavity in the housing must be appropriately configured to allow the wobble plate to undergo nutating movement. As such, the cavity preferably has opposing conical sections and opposing part-spherical sections. The part-spherical hub of the wobble plate is received in the part-spherical sections, and the flange lies between the conical sections.

Various structures can be employed to mount the wobble plate for nutating movement in the cavity. For example, in one construction, the hub has a central passage, and there is a bushing in the central passage. The bushing has a bore, and the axes of the bore and the central passage are inclined. The motor means includes a rotatable shaft received in the bore and drivingly coupled to the bushing so that rotation of the shaft imparts nutating movement to the wobble plate. This construction has the advantage of being very simple and can be lubricated by the liquid being pumped by the pump.

In another construction, the mounting means for the wobble plate includes a shaft coupled to the hub of the wobble plate and extending out of the cavity and means outside of the cavity responsive to a rotary input to move the shaft through a conical arc to impart the nutating movement to the wobble plate. One advantage of this construction is that the portion of the wobble plate mounting means which is outside the pumping chambers can be lubricated without danger of getting lubricant in the liquid being pumped. In addition, a shaft seal can be eliminated.

The housing for the pump includes at least first and second housing sections having confronting faces. The confronting faces have a complementary annular groove and annular rib, with the rib being received in the groove to accurately align the housing sections. This is particularly important so that the pumping chambers are accurately configured to accommodate the nutating movement of the wobble plate. This alignment technique eliminates the need for dowels.

The invention, together with additional features and advantages thereof, may best be understood by reference to the following description taken in connection with the accompanying illustrative drawing.

BRIEF DESCRIPTION OF THE DRAWING

FIG. 4 is an elevational view of the pump, with the housing section 25 removed.

FIG. 5 is an enlarged fragmentary sectional view taken generally along line 5—5 of FIG. 4.

DESCRIPTION OF THE PREFERRED EMBODIMENT

Figure 2:
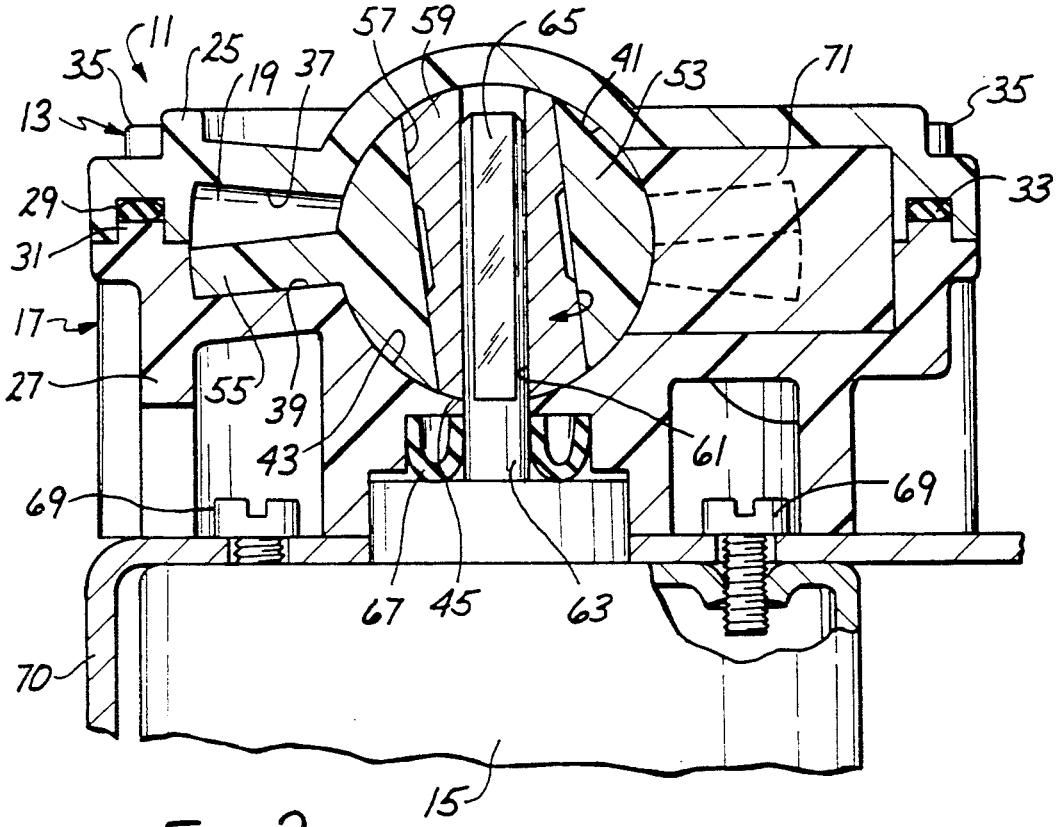
FIG. 2 is an axial sectional view through a pump assembly constructed in accordance with the teachings of this invention.
Figure 3:
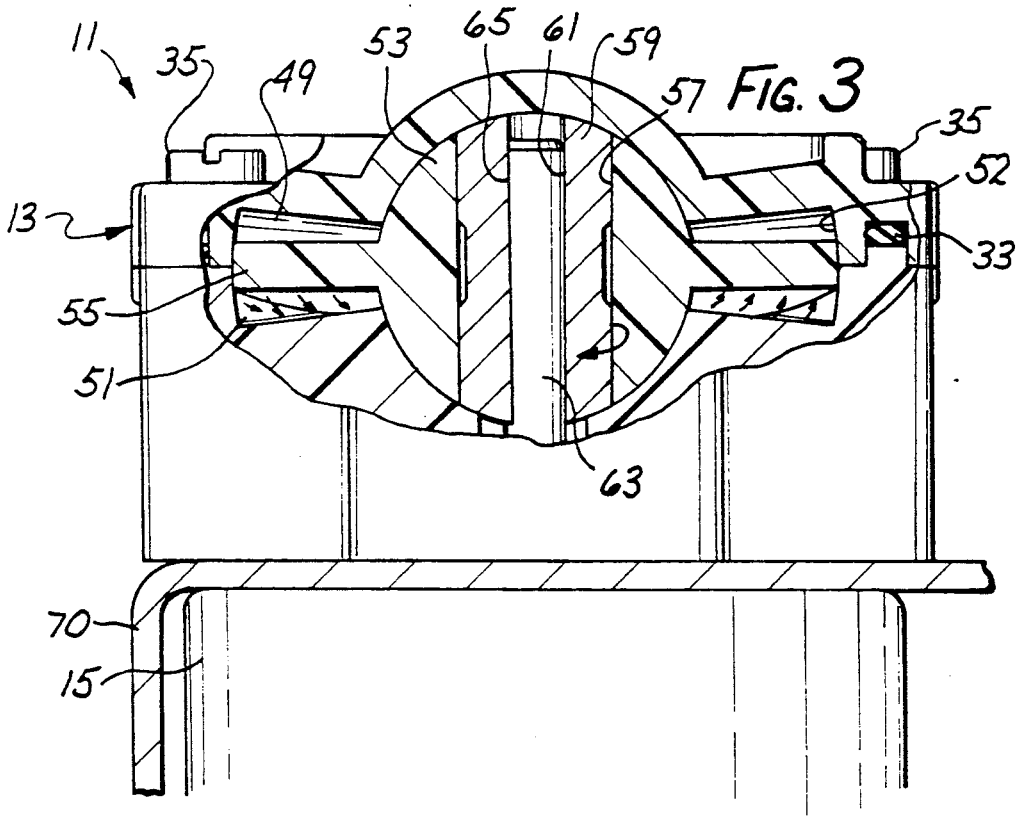
FIG. 3 is a sectional view partially in elevation taken generally along line 3—3 of FIG. 4.

FIGS. 2 and 3 show a pump assembly 11 which includes a pump 13 and a motor 15. The motor 15 may be a conventional electric motor of the type commonly used to power small pumps. Although the pump 13 can be used for pumping various liquids, in this embodiment, it is particularly adapted for pumping water or other beverages or beverage components.

The pump includes a pump housing 17 having a cavity 19 therein, an inlet 21 (FIGS. 1 and 4) leading to the cavity and an outlet 23 (FIGS. 1, 4 and 5) leading from the cavity. The pump housing 17 includes housing sections 25 and 27 having confronting faces, with the confronting face of the housing section 25 having an annular groove 29, and the confronting face of the housing section 27 having an annular rib 31 which is received within the groove 29 to axially align the housing sections. The groove 29 and the rib 31 also retain an annular seal 33, which seals between the housing sections 25 and 27. The housing sections 25 and 27 are coupled together in any suitable manner, such as by threaded fasteners 35.

The cavity 19 has opposing conical sections 37 and 39 and opposing part-spherical sections 41 and 43 formed on the inner surfaces of the housing sections 25 and 27. In addition, the housing section 27 has an axial opening 45 leading to the part-spherical section 43.

The housing sections 25 and 27 also have relatively short spherical peripheral wall sections that cooperate to define a part-spherical peripheral wall 52. This part-spherical wall 52 terminates in openings 54 and 56 (FIGS. 1 and 4) which lead to the inlet 21 and the outlet 23.

The pump 13 also includes a wobble plate 47 in the cavity 19 and dividing the cavity into pumping chambers 49 and 51 (FIG. 3). The wobble plate 47 includes a part-spherical central hub 53 received in the part-spherical sections 41 and 43 and a flange 55 between the conical sections 37 and 39. In this embodiment, the flange 55 is flat, planar and annular and just fits within the cavity 19 as shown in FIGS. 2 and 3 with sufficient clearance to allow the wobble plate to wobble.

Means is provided for mounting the wobble plate 47 for nutating movement in the cavity 19 so that liquid entering the inlet 21 into the pumping chambers 49 and 51 is pumped by the wobble plate 47 through the outlet 23. Thus, the wobble plate 47 serves as a positive displacement pumping member that acts directly against the liquid being pumped.

In the form shown in FIGS. 1-5, the mounting means includes the hub 53 having a central passage 57 therein and a bushing or eccentric 59 rotatable in the passage 57. The bushing 59 has a bore 61 extending therethrough, and the longitudinal axes of the passage 57 and the bore 61 are inclined as shown in FIG. 2.

The motor 15 has a rotatable shaft 63 which is received in the bore 61 and drivingly coupled to the bushing 59 in any suitable manner, such as by a flat surface 65 on the shaft and a mating flat surface on the bore 61.

Figure 1:
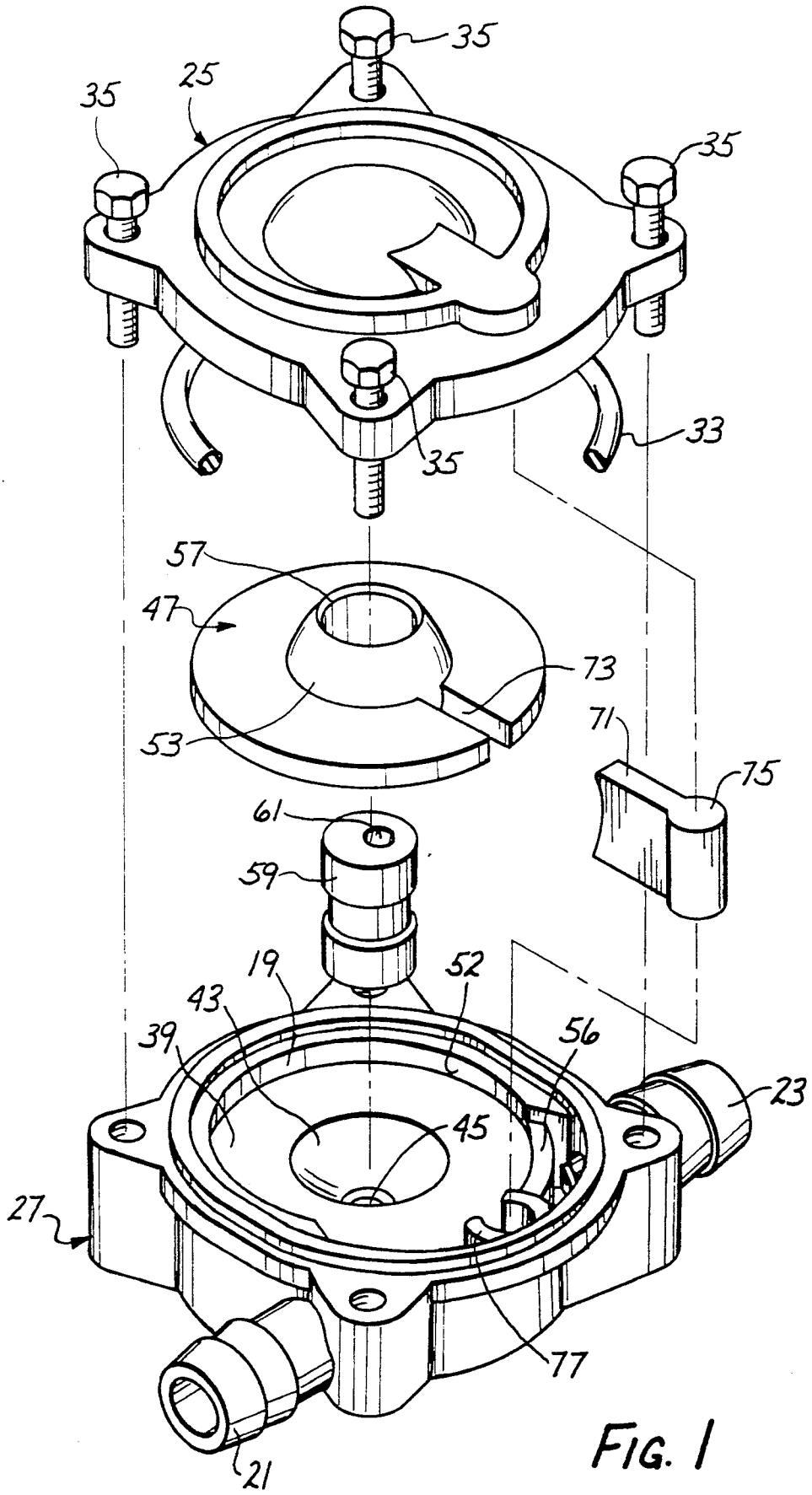
FIG. 1 is an exploded perspective view of a pump constructed in accordance with the teachings of this invention.

An annular, rotary shaft seal 67 seals the surface between the rotatable shaft 63 and the pump housing 17. The pump housing 17 is affixed to the motor 15 and a mounting bracket 70 (FIGS. 2 and 3) in any suitable manner, such as by screws 69 (FIGS. 1-3).

The means for mounting the wobble plate 47 for nutating movement also includes a separator 71 (FIGS. 1 and 4) and a slot 73 in the wobble plate 47 which receives the separator so that the separator holds the wobble plate against rotation. Accordingly, rotation of the shaft 63 causes nutating motion of the wobble plate 47.

The separator 71 also serves to separate the openings 54 and 56 which lead to the inlet 21 and the outlet 23, respectively. Thus, the separator 71 separates the inlet 21 from the outlet 23 so that the only path between the inlet and the outlet is through the pumping chambers 49 and 51.

The separator 71 can be mounted in various different ways, and in this embodiment, it includes an enlarged head 75 slidably received in a cradle 77 (FIGS. 1 and 4) to thereby fixedly mount the separator on the pump housing 17, with the separator extending radially inwardly toward the shaft 63.

The housing sections 25 and 27, the wobble plate 47, and the separator 71 can advantageously be integrally molded from a suitable plastic material. The bushing 59 is preferably constructed of a metal, such as brass or stainless steel, and the shaft 63 is preferably of metal, such as steel.

In operation, rotation of the shaft 63 by the motor 15 causes the wobble plate 47 to nutate. The liquid being pumped, such as water, enters the inlet 21 and passes through the opening 54 (FIG. 4) to the pumping chambers 49 and 51. The nutating motion of the wobble plate 47 in the pumping chambers 49 and 51 causes the water received from the inlet 21 to be moved around the pumping chambers to the opening 56 and the outlet 23. The wobble plate 47 makes line contact with the conical sections 37 and 39 at locations spaced apart 180 degrees, and the line contact moves through the pumping chambers 49 and 51 as the wobble plate nutates to achieve the pumping action. The two pumping chambers 49 and 51 continuously receive water from the inlet 21 and continuously discharge water to the outlet 23. The pumping chambers 49 and 51 operate 180 degrees out-of-phase so that the volume of water discharged by the pumping chambers 49 and 51 varies inversely. The volume discharged by each of the pumping chamber varies continuously from zero to maximum flow and then back to zero. The combined volumes discharged by both of the pumping chambers 49 and 51 is substantially constant. Consequently, there is a continuous, uninterrupted flow of water to the outlet 23 with little or no surging.

Figure 6:
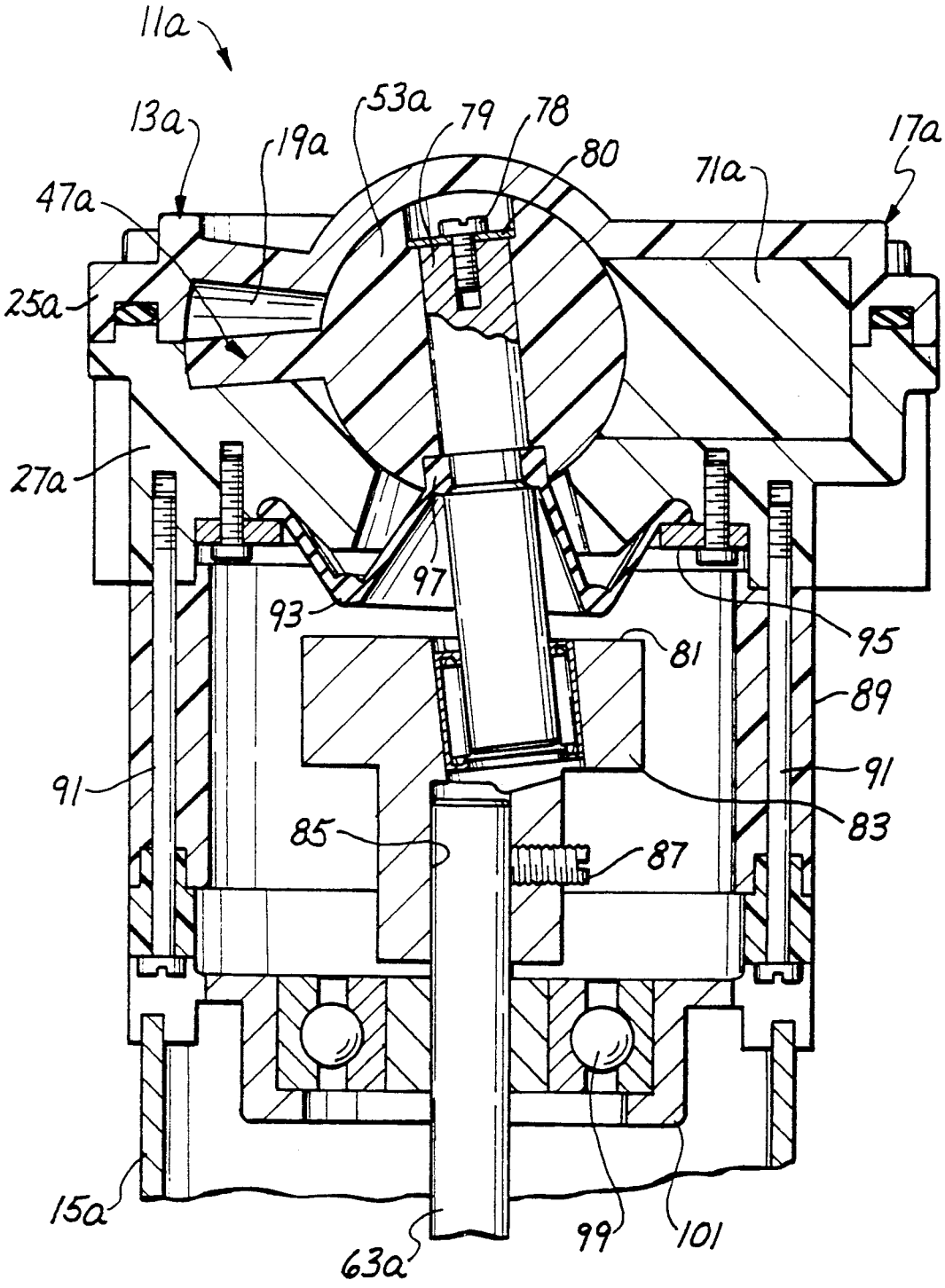
FIG. 6 is an axial sectional view through a different form of pump constructed in accordance with the teachings of this invention.

FIG. 6 shows a pumping assembly 11*a* which is identical to the pumping assembly 11 in all respects not shown or described herein. Portions of the pumping assembly 11*a* corresponding to portions of the pumping assembly 11 are designated by corresponding reference numerals followed by the letter "a." The primary difference between the pumping assemblies 11 and 11*a* is in the manner in which the wobble plate is mounted for nutating movement. More specifically, with the pump assembly 11*a*, the bushing 59 is eliminated, and a shaft 79 extends into the passage 57*a* and is suitably coupled to the hub 53*a* of the wobble plate 47*a* as by a screw 78 and washer 80. The shaft 79 extends out of the cavity 19*a* and is received in a bearing 81 eccentrically carried by a rotary drive member 83. The drive member 83 has an axial passage 85 for receiving the shaft 63*a* of the motor (not shown in FIG. 6). The drive member 83 is drivingly coupled to the motor shaft 63*a* in any suitable manner, such as by a set screw 87.

The pump housing 17*a* also includes a tubular housing extension 89, which is joined to the housing section 27*a* by screws 91. The housing extension 89 houses the drive member 83 and receives portions of the shafts 63*a* and 79. The shaft seal 67 of the embodiment of FIGS. 1–5 is eliminated in favor of a flexible bellows-type seal 93 which is held against the housing section 27*a* by a retainer 95 and which has a bead 97 which surrounds and sealingly engages the shaft 79. Because the shaft 79 undergoes a conical motion and does not rotate about its axis, sealing of the shaft is facilitated. The shaft 63*a* is supported for rotation by a ball bearing 99 carried by a bearing retainer 101 mounted on the housing extension 89 and the motor 15*a* in any suitable manner, such as by screws (not shown).

Rotation of the shaft 63*a* by the motor rotates the drive member 83 about its axis, and this drives the shaft 79 along a conical path to cause the wobble plate 47*a* to nutate. The pumping action of the pump 13*a* is identical to the pumping action of the pump 13. However, this embodiment has the advantage of having the bearing 81 out of the cavity 19*a* so that lubricants can be used on the bearing without contaminating the liquid being pumped. In addition, this embodiment enables the use of the bellows seal 93 rather than the rotary shaft seal 67.

Although exemplary embodiments of the invention have been shown and described, many changes, modifications and substitutions may be made by one having ordinary skill in the art without necessarily departing from the spirit and scope of this invention.

We claim:

1. A pump comprising:

a housing having a cavity with opposing part-spherical sections, said housing having an inlet leading to said cavity and an outlet leading from said cavity;

a wobble plate in said cavity and dividing said cavity into first and second pumping chambers, the wobble plate including a central part-spherical hub and a flange circumscribing the hub, said central hub being between said opposing part-spherical sections of said cavity;

means for mounting the wobble plate for nutating movement in said cavity whereby liquid entering the inlet into the pumping chambers is pumped by the wobble plate through the outlets;

motor means including a rotatable shaft for driving the wobble plate in said nutating movement; and said mounting means including a central passage in the central hub of the wobble plate, a bushing in the central passage and having a bore therein which drivingly receives the rotatable shaft of the motor means, said bushing being separate from the motor shaft and having opposite ends which confront and are between the opposing part-spherical sections of said cavity, the axes of the central passage and the bore being inclined relative to each other whereby a rotary input applied to the bushing along the axis of the bore by the rotatable shaft of the motor means imparts said nutating movement to the wobble plate.

2. A pump as defined in claim 1 wherein said cavity has opposing conical sections and the flange is between said conical sections.

3. A pump as defined in claim 1 wherein one of said part-spherical sections has an opening for receiving the rotatable shaft of the motor means and the rotatable shaft terminates in said cavity.

4. A pump assembly as defined in claim 1 wherein said housing includes first and second housing sections having confronting faces, an annular groove in the confronting face of the first housing section and annular rib on the confronting face of the second housing section, said rib being received in said groove and means for coupling said housing sections together.

5. A pump as defined in claim 1 wherein said pump includes a separator separating said inlet and said outlet and said mounting means includes said wobble plate having a slot which receives the separator whereby the separator holds the wobble plate against rotation.

6. A pump as defined in claim 1 wherein said housing includes first and second housing sections having confronting faces, an annular groove in the confronting face of the first housing section and annular rib on the confronting face of the second housing section, said rib being received in said groove and means for coupling said housing sections together.

* * * * *